US006099081A

United States Patent [19]

Warren et al.

[11] Patent Number: 6,099,081

[45] Date of Patent: Aug. 8, 2000

[54] POINT ATTACK TOOLING SYSTEM FOR MINERAL WINNING

[75] Inventors: John Joseph Warren; William Stephen Clapham, both of Sheffield, United Kingdom

[73] Assignee: Hydra Tools International Limited, United Kingdom

[21] Appl. No.: 09/137,204

[22] Filed: Aug. 20, 1998

[30] Foreign Application Priority Data

Sep. 6, 1997 [GB] United Kingdom ..... 9718869
Mar. 4, 1998 [GB] United Kingdom ..... 9804488

[51] Int. Cl.[7] ..... E21C 35/18; E21C 35/183; E21C 35/197

[52] U.S. Cl. ..... 299/104; 299/79.1; 299/81.1; 299/81.3; 299/85.2

[58] Field of Search ..... 299/104, 79.1, 299/81.1, 81.3, 85.2; 411/510, 508, 509, 353

[56] References Cited

U.S. PATENT DOCUMENTS

| | | | |
|---|---|---|---|
| D. 413,126 | 8/1999 | Warren et al. | D15/21 |
| D. 420,013 | 2/2000 | Warren et al. | D15/21 |
| 3,841,708 | 10/1974 | Kniff et al. | 299/104 |
| 4,333,687 | 6/1982 | Barnstorf | 299/81.1 |
| 4,489,986 | 12/1984 | Dziak | 299/79.1 |
| 4,678,238 | 7/1987 | Emmerich | 299/81.1 |
| 5,098,167 | 3/1992 | Latham | 299/86 |
| 5,106,166 | 4/1992 | O'Neill | 299/104 |
| 5,232,322 | 8/1993 | Regensburger | 411/353 |
| 5,628,549 | 5/1997 | Ritchey et al. | 299/104 |
| 5,730,502 | 3/1998 | Montgomery, Jr. | 299/104 |

FOREIGN PATENT DOCUMENTS 2247705 11/1992 United Kingdom .

*Primary Examiner*—Eileen Dunn Lillis
*Assistant Examiner*—John Kreck
*Attorney, Agent, or Firm*—Trexler, Bushnell, Giangiorgi & Blackstone, Ltd.

[57] ABSTRACT

A pick box (1) of a tooling system for mineral winning etc., has an elongated aperture (4) to receive, in use, a removable liner sleeve (6) of the tooling system, the box (1) providing a seating surface (7) extending orthogonally with respect to the axis (5) of the aperture (4). The external periphery of the sleeve (6) and the internal periphery (8) of the box aperture (4) are so profiled, e.g. hexagonally, as to prevent relative rotation and the internal periphery of the box aperture is interrupted at (11) to provide at least one surface for engagement, in use, with a retainer device (12) of an inserted sleeve (6), whilst the sleeve has an external groove (22) to receive a retainer device (12). The invention also includes a sleeve (6) having an enlarged head (16), a longitudinal circular bore (26), and a circumferential groove (22) fitted with a retainer ring (12). The invention further includes a box (1) and a sleeve (6) in combination, and a drum (3).

9 Claims, 4 Drawing Sheets

POINT ATTACK TOOLING SYSTEM FOR MINERAL WINNING

FIELD OF THE INVENTION

This invention relates generally to a so-called point-attack tooling system and specifically to a pick box; to a liner sleeve for releasable retention within an aperture of the pick box, with the sleeve being adapted to releasably receive the circular section shank of an industry-standard point-attack pick; to a pick and box combination, and to a rotary, mineral winning head provided with a plurality of such pick and box combinations, such a head being employed on a so-called continuous mining machine, a shearer machine or a road-header machine. Similar tooling systems are used in civil engineering as part of road, or runway re-surfacing in so-called road planing machines and operations.

BACKGROUND OF THE INVENTION

As pick boxes are secured to rotary cutting heads by welding and as welding, to replace a worn or damaged pick box, cannot normally be effected in a UK coal mine due to safety regulations, a knock-in, knock-out liner sleeve is frequently used to obviate damage to the pick box, in service—with a worn or damaged sleeve being replaced instead of a worn or damaged pick box.

Known liner sleeves conventionally include at an "outer" end an enlarged head having a seating surface, to seat on an annular seating surface of the pick box. Some sleeves have been intended to rotate, in service, with a view to obtaining even wear on the sleeve and in particular on its enlarged head, which system involves deliberately manufacturing clearances into the components to permit rotation, but the play resulting from such a relatively loose fit causes fretting (progressive enlargement of the play due to metal deformation) in service which in turn results in premature wear between the sleeve and the box aperture. Other proposals have been for a non-rotatable, press-fit sleeve, but impactions sustained in service, coal etc., fines ingress, and rusting, make it difficult, if not impossible, to remove a press-fit sleeve in confined mine conditions, so that worn sleeves often remain in service, resulting in box wear rather than box protection.

Other proposals for non-rotatable sleeves are disclosed in U.S. Pat. No. 5,106,166.

Also, a pick box, into which the sleeve is releasably fitted, is usually provided with a receiving aperture for a water spray nozzle, to discharge a cone etc., of water vapour in the vicinity of the tip of the pick. With a view to protecting the nozzle from damage, so-called rear entry spray nozzles are widely employed, but the location of some such sprays compromises the ability to direct the spray cone in the optimally required location, due to interference of ancillary components, particularly the conventionally provided enlarged head of the sleeve.

OBJECT OF THE INVENTION

A basic object of the invention is the provision of an improved point attack tooling system, and its components, over known proposals.

SUMMARY OF THE INVENTION

According to a first aspect of the present invention, there is provided a pick box having an elongated aperture to receive, in use, a removable liner sleeve having an enlarged head, the box providing a seating surface extending orthogonally with respect to the elongated aperture for engagement, in use, by the enlarged head, characterised in that the internal periphery of the box aperture and the complementary external periphery of an inserted sleeve are so profiled as to prevent relative rotation, and in that the internal periphery of the box aperture is interrupted to provide at least one surface for engagement, in use, with a retainer device of an inserted sleeve.

The profiling to prevent rotation could for instance be by the box aperture having a noncircular, e.g. oval, cross-section, with the external periphery of the sleeve having a corresponding profile. Preferably however, such profiling is by providing the box aperture with at least one flat for engagement by an abutment, preferably in the form of another flat, provided on the external periphery of the sleeve.

It follows that, with one flat, the box aperture and the external periphery of the sleeve may be of "D"-section, or generally so. Preferably however, a plurality of flats are provided whereby the sleeve, if, as is usually the case, is not worn evenly over 360° but is worn only over a selected area, may be removed, indexed and replaced, to present a fresh, non-worn area. Thus, two, parallel flats may be provided 180° apart, to provide one indexation facility. To provide increased indexation facilities, the box aperture may be hexagonal, with a corresponding hexagonal external profile on the sleeve, whereby the sleeve may be indexed through 60° positions to enable, in total, six different wear areas to be presented, before sleeve replacement is necessary.

The interruption to the internal periphery of the box aperture may be by the provision of a recess or groove. A plurality of recesses or grooves may be provided, in which case they may simply be formed by a screw-thread cut into the internal periphery of the box aperture.

Preferably, the end of the aperture adjacent the seating surface of the box, is counter-bored over a relatively short axial length.

Preferably, the pick box is provided with a socket to house, or housing, a water spray nozzle, with the socket having a longitudinal axis that is parallel to the box aperture axis.

According to a second aspect of the invention, of independent significance, there is provided a sleeve adapted, in use, to engage a receiving aperture of a pick box, the sleeve having an enlarged head at one end thereof, which head provides an annular seating surface adapted, in use, to seat on a face of an associated pick box, the enlarged head also having a frusto-conical flank, whilst a longitudinally extending, circular section bore is provided co-axially of the sleeve and adapted to releasably receive a circular section shank of a replaceable, mineral cutter pick, the external periphery of the sleeve and the complementary internal periphery of the box aperture into which the sleeve, in use, is adapted to be inserted, being so profiled as to prevent relative rotation, and the sleeve having, intermediate its ends, a circumferential groove into which is fitted a retainer ring, which projects beyond the external periphery of the sleeve.

The retainer ring is preferably of synthetic plastics material and is preferably ribbed and serves for releasable retaining of the sleeve within the box aperture, precluding inadvertent loss of the sleeve from the box yet permitting relatively simple extraction of a worn sleeve, for indexation or replacement, by the sleeve being hammered out of the box. Such ribbed retainer is, in use, engageable with the interruption in the box aperture. The shank receiving bore of the sleeve is provided with at least one internal, circumferential groove for engagement by a releasable latching device, e.g. an industry-standard resilient spring steel ring, loosely mounted in a retaining groove of a shank of the pick, for latching the pick into the sleeve.

The means to prevent rotation is preferably at least one flat. Six flats are preferably provided, resulting in a hexagonal profile.

At the transition area between the sleeve and its enlarged head, an intermediate collar may be provided of relatively short axial length, and of greater diameter than the sleeve, but lesser diameter than the enlarged head.

In one embodiment, the frusto-conical flank of the enlarged collar is relieved by at least one flute, whereby a portion of an associated water spray may pass through the flute.

Thus, with the sleeve in accordance with the first aspect of the invention, the enlarged head, or a portion thereof, no longer impedes the desired projection of the water spray, as the relief provided by the flute(s) enables a portion of the spray to reach the optimum location in the vicinity of a tip of a pick.

Preferably, a plurality of flutes—two, four or six—are provided so that, with the sleeve in accordance with the first aspect, the sleeve may be located non-rotationally, in a predetermined orientation, so that consequently a selected flute is presented in correct location with regard to an adjacent spray nozzle of the pick box. Furthermore, a sleeve with multiple flats may, after wear, be removed, indexed, and replaced as the provision of a plurality of flutes ensures that, after indexing, another flute is again presented in correct location with regard to the spray nozzle.

The end of the sleeve distal from its enlarged head is preferably provided with a circular groove to receive a circlip externally of the elongated aperture of the pick box.

According to a third aspect of the invention of independent significance, there is provided, in combination, a pick box in accordance with the first aspect, and a sleeve in accordance with the second aspect.

According to a fourth aspect of the invention of independent significance, there is provided a mineral cutter drum provided with a plurality of pick boxes in accordance with the first aspect.

The various aspect of the invention that together make up a point attack tooling system for mineral winning, etc., will now be described, in greater detail, by way of example, with reference to the accompanying drawings, in which.

Figure 4:
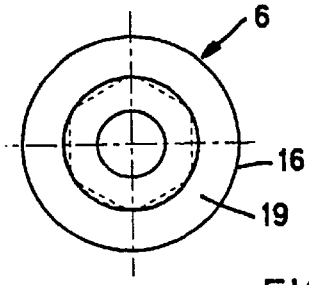
FIGS. 3, 4 and 5, are, respectively, a side elevation, a plan view and an axial sectional view of a first embodiment of sleeve in accordance with the second aspect of the invention.
Figure 5:
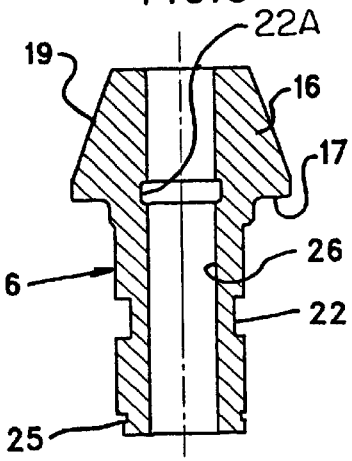
Figure 3:
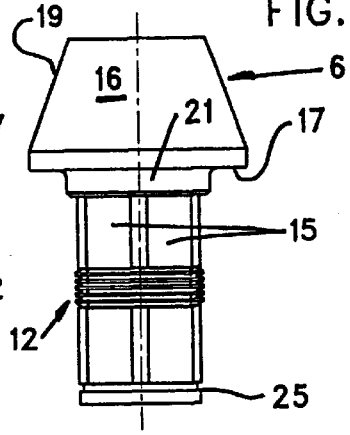
Figure 7:
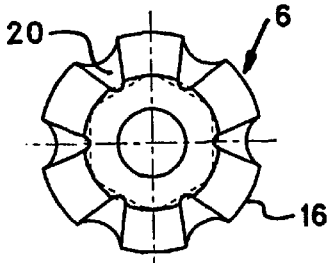
Figure 8:
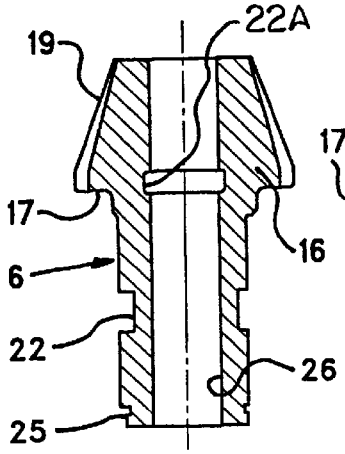
Figure 6:
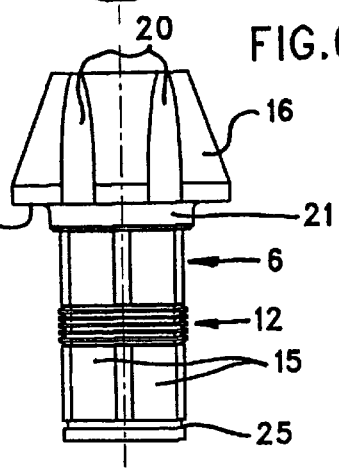
Figure 10:
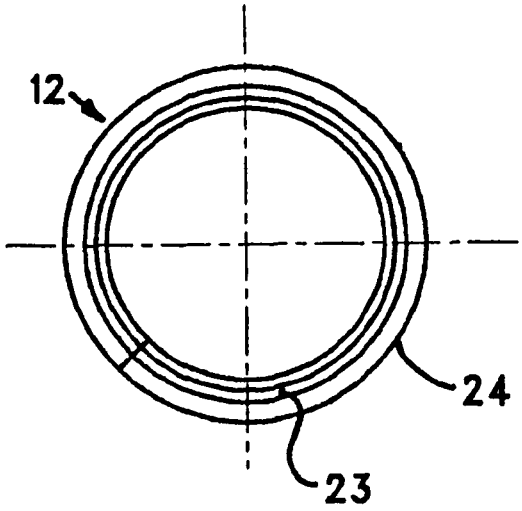
Figure 9:
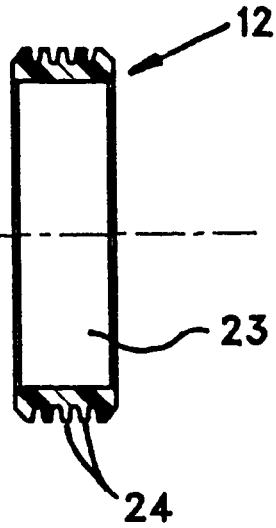
Figure 11:
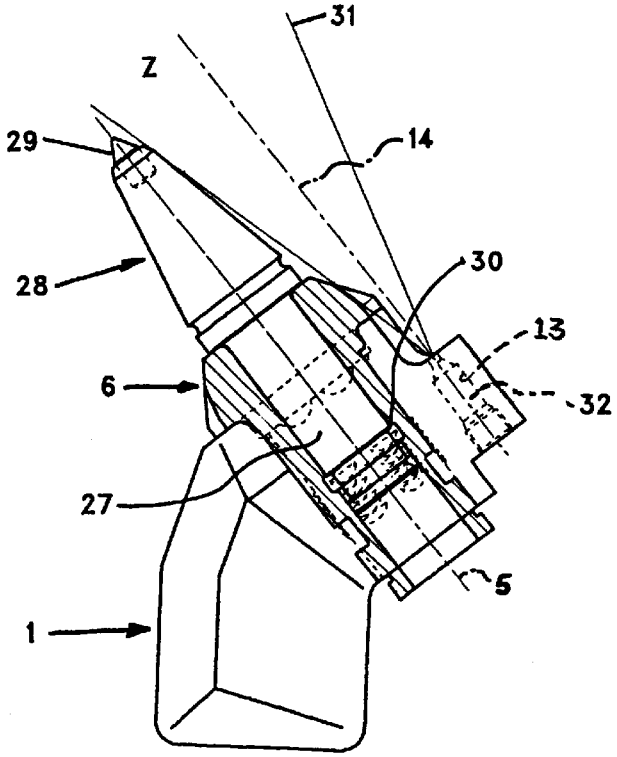
Figure 12:
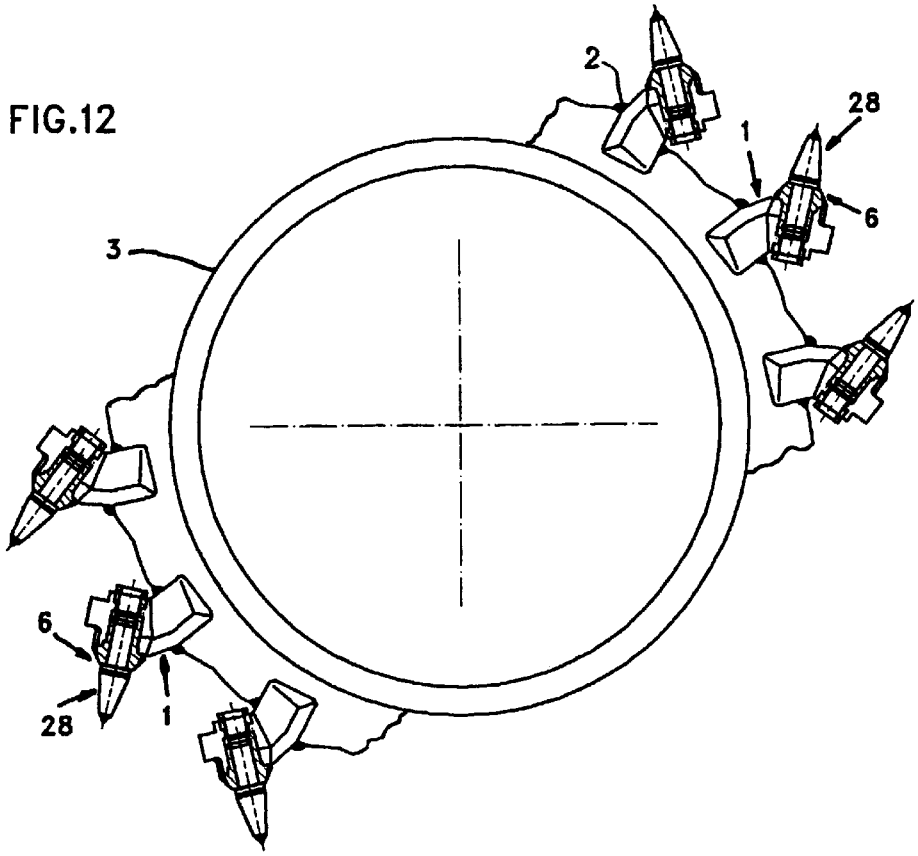

FIGS. 6, 7 and 8 correspond to FIGS. 3, 4 and 5, but show a second embodiment of sleeve in accordance with the second aspect of the invention;

FIGS. 9 and 10 are respectively a sectional side view and a front elevation of a retaining member for use with the sleeves of FIGS. 3 to 8;

FIG. 11 is a part sectional side elevation of a combination in accordance with the third aspect of the invention; and FIG. 12 is a diagrammatic end view of a rotary mineral cutter drum in accordance with the fourth aspect of the invention.

Figure 1:
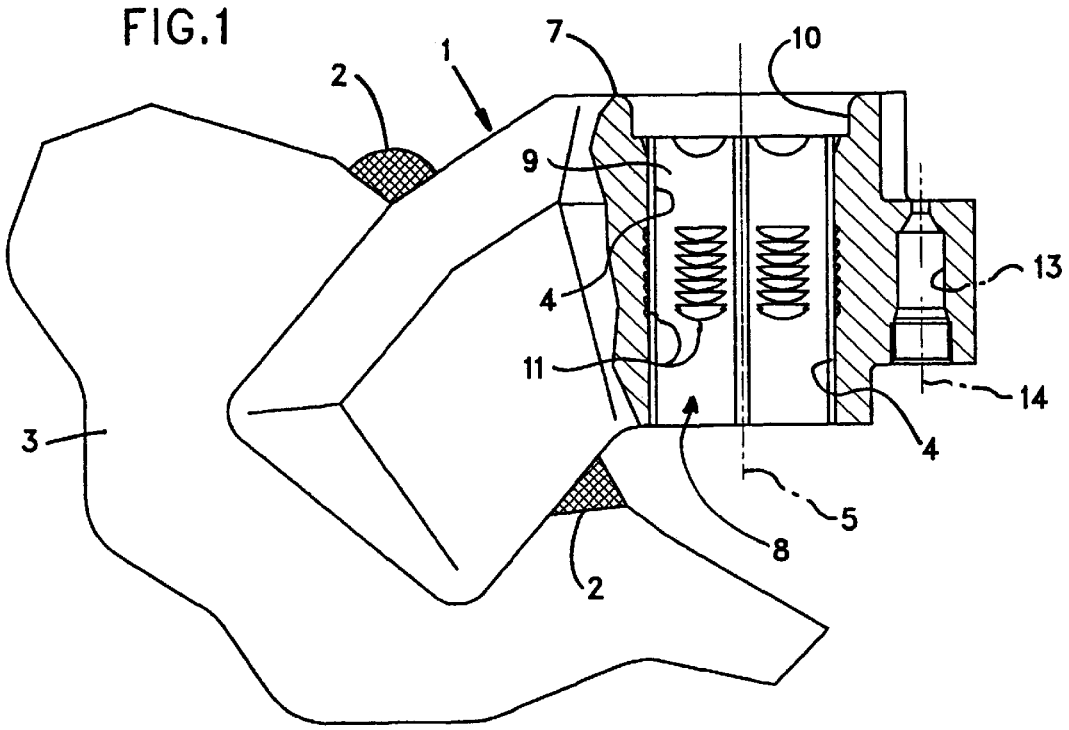
FIG. 1 is a part sectional side elevation of a pick box in accordance with a first aspect of the invention.
Figure 2:
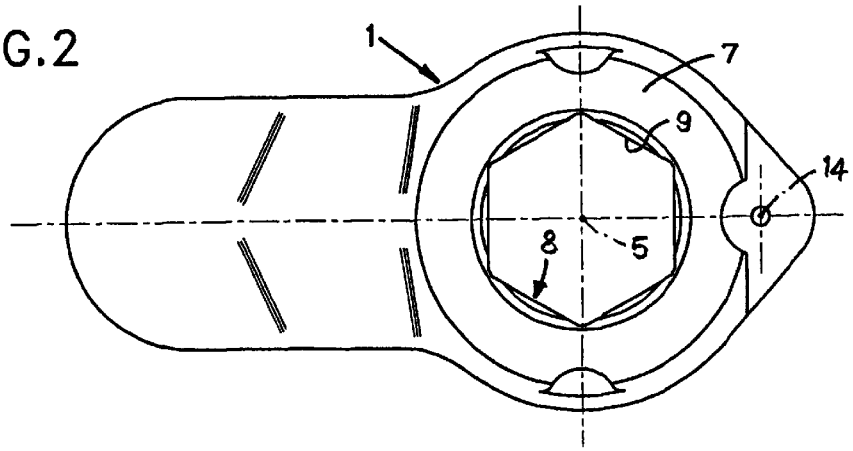
FIG. 2 is a plan view of FIG. 1.

In FIGS. 1 and 2 is illustrated a pick box 1 in accordance with the first aspect of the invention, which box 1 is adapted, in use, to be secured by weld metal 2 to the periphery of a drum or vane of a rotary cutting head 3 adapted to be mounted on a mineral winning machine, road planing machine etc (not shown).

The box 1 is provided with an elongated aperture 4 having an axis 5 and adapted, in use, to receive a replaceable liner sleeve 6, (to be described in detail later) and for example of the kind illustrated in FIGS. 3 to 8. The pick box 1 is provided with a seating surface 7 extending orthogonally to the aperture 4 and its axis 5, and as best seen in FIG. 2, the aperture 4 has an internal periphery 8 of hexagonal profile defined by six flats 9. The aperture 4, at its end adjacent the seating surface 7, is provided with a counterbore 10 of relatively short axial length. Furthermore, the internal periphery 8 of the aperture 4 is interrupted by the provision, of screw threads 11 adapted to be engaged, in use, by a retainer device 12 (to be described in detail later) of an inserted sleeve 6. The box 1 is also provided with a socket 13 having a longitudinal axis 14 that is parallel to the axis 5 of the aperture 4.

With the two embodiments of sleeve 6 in accordance with the second aspect of the invention illustrated in FIGS. 3 to 8, like reference numerals are used for like components.

As the sleeve 6 is adapted, in use, to fit into the hexagonal aperture 4 of the box 1, the sleeve 6 is, of course, provided with a corresponding hexagonal external profile defined by six flats 15. The sleeve 6 has at one end an enlarged head 16 provided with an annular, and radially extending seating surface 17 adapted, in use, to seat on the seating surface 7 of the pick box 1, the head 16 having a frusto-conical flank 19 which, in the embodiment of FIGS. 6 to 8, is provided with six equally spaced grooves or flutes 20. At a transition area between the sleeve 6 and its head 16, an intermediate collar 21 is provided of relatively short axial length, and of greater diameter than the sleeve 6 but lesser diameter than the head 16. By the provision of the hexagonal aperture 4 and the hexagonal external profile of the sleeve 6, firstly rotation of the sleeve 6 with respect to the box 1 is prevented, and secondly, after initial wear over one area of the head 16, the sleeve 6 may be removed, indexed through 60° and replaced, to present fresh, unworn areas of the head 16, thereby extending the service life of the sleeve 6.

Approximately mid-way along its length, the sleeve 6 is provided externally with a circumferential groove 22 to receive the retainer device 12 which is constituted by a split ring 23 of synthetic plastics material, best seen in FIGS. 10 and 11, and having a plurality of ribs 24 extending circumferentially beyond the periphery of the sleeve 6, and adapted, in use, to engage the threads 11 of the box aperture 4. Also, the end of the sleeve 6 distal from the enlarged head 16 is provided a circumferential groove 25 adapted to receive a circlip (not shown).

A circular section, longitudinally extending bore 26 extends through the sleeve 6 and, in use, is co-axial with the axis 5 of the pick box 1. The bore 26 is adapted, in use, to receive (as shown in FIG. 11) a circular section shank 27 of an industry-standard, replaceable, point attack mineral cutter pick 28, conventionally provided with a carbide tip 29. In order that the pick 28 may be releasably retained within the bore 26, the circumferential groove 22A, is adapted to be engaged by an industry-standard latching device 30. e.g. a spring steel ring, carried by the shank 27 of the pick 28.

The embodiment of sleeve 6 shown in FIGS. 6 to 8 is more suited to a so-called "wet" tooling system in which pressurised water is supplied to the rotary cutting head 3 for emission of water sprays (for various well-known reasons) from a plurality of spray nozzles 32 (FIG. 11). Thus, because of the ability to index the sleeve 6, the position of the flutes 20 can be positively oriented, so that, as illustrated in FIG. 11, a portion of a conical water spray 31 emitted by the water spray nozzle 32 located within the socket 13 of the pick box 1 is not obstructed by the enlarged head 16 of the sleeve 6 but on the contrary is permitted to deliver water through a flute 20 to a zone Z adjacent the tip 29 of the pick 28.

In FIG. 12, the rotary cutting head 3 is shown provided with a plurality of pick boxes 1 (and in practice at least fifty would normally be provided) in accordance with the first aspect of the invention, welded in position and each fitted with a sleeve 6 in accordance with the second aspect of the invention, each sleeve 6 being fitted with a pick 28.

What we claim is:

1. A pick box comprising: an elongated aperture to receive, in use, a removable liner sleeve having an enlarged head, said pick box providing a seating surface extending orthogonally with respect to said elongated aperture for engagement, in use, by the enlarged head, wherein the internal periphery of said elongated aperture and the complementary external periphery of an inserted sleeve are so profiled as to prevent relative rotation, and said internal periphery of said elongated aperture is interrupted to provide at least one surface for engagement, in use, with a retainer device of an inserted sleeve, said interruption to said internal periphery of said elongated aperture being by the provision of a plurality of recesses or grooves formed by a screw-thread cut into said internal periphery of said elongated aperture.

2. A pick box as claimed in claim 1, wherein said profiling to prevent rotation is by said pick box aperture having a non-circular cross-section.

3. A pick box as claimed in claim 2, wherein said non-circular cross-section includes a plurality of flats.

4. A pick box as claimed in claim 3, incorporating six flats.

5. A pick box as claimed in claim 1, wherein said box aperture adjacent said seating surface of said box is counter-bored over a relatively short axial length.

6. A pick box as claimed in claim 1, provided with a socket adapted to house a water spray nozzle.

7. A pick box as claimed in claim 6, wherein said socket has a longitudinal axis parallel to the longitudinal axis of said box aperture.

8. In combination, a pick box and a sleeve, said sleeve comprising an enlarged head at one end thereof which head provides an annular seating surface, and a frusto-conical flank, whilst a longitudinally extending, circular section bore is provided co-axially of said sleeve and adapted, in use, to releasably receive a circular section shank of a replaceable, mineral cutter pick, and said sleeve having, intermediate its ends, a circumferential groove into which is fitted a retainer ring, which projects beyond the external periphery of said sleeve;

said pick box comprising an elongated receiving aperture to receive, in use, said sleeve, said pick box providing a seating surface extending orthogonally with respect to said elongated aperture for engagement, in use, by said enlarged head of said sleeve, wherein the internal periphery of said elongated aperture and the complementary external periphery of said sleeve when inserted are so profiled as to prevent relative rotation, and said internal periphery of said elongated aperture is interrupted to provide at least one surface for engagement, in use, with a retainer device of said sleeve when inserted, said interruption to said internal periphery of said elongated aperture being by the provision of a plurality of recesses or grooves formed by a screw-thread cut into said internal periphery of said elongated aperture.

9. A mineral cutter drum in combination with a plurality of pick boxes, said mineral cutter drum comprising a rotary cutting head; and each said pick box being mounted on said rotary cutting head, each said pick box comprising an elongated aperture to receive, in use, a removable liner sleeve having an enlarged head, said pick box providing a seating surface extending orthogonally with respect to said elongated aperture for engagement, in use, by the enlarged head, wherein the internal periphery of said elongated aperture and the complementary external periphery of an inserted sleeve are so profiled as to prevent relative rotation, and said internal periphery of said elongated aperture is interrupted to provide at least one surface for engagement, in use, with a retainer device of an inserted sleeve, said interruption to said internal periphery of said elongated aperture being by the provision of a plurality of recesses or grooves formed by a screw-thread cut into said internal periphery of said elongated aperture.

* * * * *